US009631480B2

(12) United States Patent
Cooper et al.

(10) Patent No.: US 9,631,480 B2
(45) Date of Patent: Apr. 25, 2017

(54) ACOUSTIC VELOCITY MEASUREMENTS USING TILTED TRANSDUCERS

(75) Inventors: Paul Cooper, Houston, TX (US); Kristopher V Sherrill, Humble, TX (US); Ricardo Ortiz, Houston, TX (US); Daniel Flores, Round Rock, TX (US); Batakrishna Mandal, Missouri City, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 1463 days.

(21) Appl. No.: 13/264,336

(22) PCT Filed: Jul. 16, 2009

(86) PCT No.: PCT/US2009/050859

§ 371 (c)(1),
(2), (4) Date: Apr. 5, 2012

(87) PCT Pub. No.: WO2010/132070

PCT Pub. Date: Nov. 18, 2010

(65) Prior Publication Data

US 2012/0182831 A1 Jul. 19, 2012

(30) Foreign Application Priority Data

May 11, 2009 (WO) ..... PCT/US2009/002905

(51) Int. Cl.
*E21B 47/10* (2012.01)

(52) U.S. Cl.
CPC ..... *E21B 47/101* (2013.01)

(58) Field of Classification Search
CPC ..... E21B 47/101
See application file for complete search history.

(56) References Cited

U.S. PATENT DOCUMENTS 3,363,719 A 1/1968 Alexis
3,542,150 A * 11/1970 Guy ..... G01S 1/72 181/104

(Continued)

FOREIGN PATENT DOCUMENTS

DE 3503488 A1 7/1986
EP 0837217 A2 4/1998

(Continued)

OTHER PUBLICATIONS

"International Application Serial No. PCI/US2009/002905, International. PreliminaryReport on Patentability mailed Nov. 24, 2011", 8 pgs.

(Continued)

*Primary Examiner* — Krystine Breier
(74) *Attorney, Agent, or Firm* — Gilliam IP PLLC

(57) ABSTRACT

Apparatus, systems, and methods may operate to emit acoustic pulses into a drilling fluid in a well bore, using a first acoustic transducer in a downhole tool, and detecting the acoustic pulses after reflection from the wall of the well bore, using a second acoustic transducer in the downhole tool. The faces of the first and second acoustic transducers are non-parallel. Further activities include emitting additional acoustic pulses into the drilling fluid using the second acoustic transducer, and detecting them using the second acoustic transducer. The acoustic velocity of the drilling fluid can be determined based on respective travel times. Additional apparatus, systems, and methods are described.

37 Claims, 6 Drawing Sheets

(56) References Cited

U.S. PATENT DOCUMENTS

| | | | | |
|---|---|---|---|---|
| 3,648,513 | A | 3/1972 | Patterson | |
| 3,937,060 | A * | 2/1976 | Lewis | G01N 7/14 73/152.04 |
| 4,208,906 | A | 6/1980 | Roberts, Jr. et al. | |
| 4,601,024 | A | 7/1986 | Broding | |
| 4,665,511 | A * | 5/1987 | Rodney | E21B 47/082 367/27 |
| 5,341,345 | A | 8/1994 | Warner et al. | |
| 5,533,402 | A | 7/1996 | Sarvazyan et al. | |
| 6,021,093 | A | 2/2000 | Birchak et al. | |
| 6,125,079 | A | 9/2000 | Birchak et al. | |
| 6,305,233 | B1 * | 10/2001 | Braathen | G01F 1/667 73/861.27 |
| 6,618,322 | B1 | 9/2003 | Georgi | |
| 6,938,458 | B2 | 9/2005 | Han et al. | |
| 2004/0003658 | A1 * | 1/2004 | Han | E21B 47/01 73/152.47 |
| 2004/0095847 | A1 | 5/2004 | Hassan et al. | |
| 2005/0034530 | A1 | 2/2005 | Han et al. | |
| 2005/0259512 | A1 | 11/2005 | Mandal | |
| 2007/0022803 | A1 | 2/2007 | DiFoggio et al. | |
| 2008/0186805 | A1 | 8/2008 | Han | |

FOREIGN PATENT DOCUMENTS

| | | | | |
|---|---|---|---|---|
| EP | 1441105 | A1 | 7/2004 | |
| WO | WO-0104969 | A1 | 1/2001 | |
| WO | WO-0135124 | A1 | 5/2001 | |
| WO | WO 2005100978 | A1 * | 10/2005 | G01N 29/024 |
| WO | WO-2005100978 | A1 | 10/2005 | |
| WO | WO-2010132039 | A1 | 11/2010 | |
| WO | WO-2010132070 | A1 | 11/2010 | |

OTHER PUBLICATIONS

"International Application Serial No. PCT/US2009/050859, International Preliminary Report on Patentability rnailed Feb. 23, 2012", 27 pgs.

"International Application Serial No. PCT/US2009/50859, Amendment and Response filed Sep. 13, 2011 to Written Opinion mailed Aug. 15, 2011", 5 pgs.

"International Application Serial No. PCT/US2009/002905, Search Report mailed Feb. 19, 2010".

"International Application Serial No. PCT/US2009/002905, Written Opinion mailed Feb. 19, 2010".

"International Application Serial No. PCT/US2009/050859, Invitation to Pay Add'l Fees Rcvd mailed Aug. 18, 2009".

"International Application Serial No. PCT/US2009/050859, Search Report mailed Nov. 2, 2009".

"International Application Serial No. PCT/US2009/050859, Written Opinion mailed Nov. 2, 2009".

"International Application Serial No. PCT/US2009/50859, Written Opinion mailed Aug. 15, 2011", 21 pgs.

* cited by examiner

ACOUSTIC VELOCITY MEASUREMENTS USING TILTED TRANSDUCERS

RELATED APPLICATIONS

This application is a U.S. National Stage Filing under 3 5 U.S.C. 371 from International Application No. PCT/US2009/050859, filed on Jul. 16, 2009, and published as WO 2010/132070 A1 on Nov. 18, 2010, which claims priority under 35 U.S.C. 120 to PCT/US2009/002905, filed on May 11, 2009, and published as WO 2010/132039 on Nov. 18, 2010; which applications and publications are incorporated herein by reference in their entirety.

BACKGROUND

During drilling operations for extraction of hydrocarbons, an accurate determination of a shape of a borehole is important. In particular, a number of other downhole measurements are sensitive to a stand-off of the downhole tools from the formation. Knowledge of the borehole shape may be required to apply corrections to these downhole measurements. A determination of the shape of the borehole has various other applications. For example, for completing a well, an accurate knowledge of the borehole shape is important in hole-volume calculations for cementing.

BRIEF DESCRIPTION OF THE DRAWINGS

The embodiments are provided by way of example and not limitation in the figures of the accompanying drawings, in which like references indicate similar elements and in which.

DETAILED DESCRIPTION

Methods, apparatus and systems for acoustic velocity measurements using tilted transducers are described. In the following description, numerous specific details are set forth. However, it is understood that embodiments of the invention may be practiced without these specific details. In other instances, well-known circuits, structures and techniques have not been shown in detail in order not to obscure the understanding of this description. Some embodiments may be used in Measurement While Drilling (MWD), Logging While Drilling (LWD) and wireline operations.

In example embodiments, a downhole tool comprises tilted (angled) and non-tilted transducers relative to the outer surface of the downhole tool. These transducers may be acoustic transducers that are used to measure a velocity of sound (e.g., ultrasound) propagation in the drilling fluid in a downhole environment. In example embodiments, a downhole tool comprises a non-tilted transducer that operates in a pulse-echo mode to receive an echo of a pulse that is reflected off the formation wall or well bore. Further, the downhole tool may comprise a tilted transducer that operates in a pitch-catch mode with a different transducer. In some embodiments, the tilted transducer may operate in a pitch-catch mode with the non-tilted transducer that is also operating in the pulse-echo mode. Alternatively or in addition, the tilted transducer may operate in a pitch-catch mode with a different non-tilted transducer. While described such that the transducers are positioned in a downhole tool, some embodiments are not so limited. The transducers may be positioned at different locations along the drill string or wireline tool. For example, in some embodiments, one or more of the transducers may be positioned within the drill bit of the drill string.

In some embodiments, a single dual-element transducer may be used to measure the velocity of sound propagation in the drilling fluid. The dual-element transducer may comprise a first transducer element that is non-tilted relative to the outer surface of the downhole tool. The dual-element transducer may also comprise a second transducer element that is tilted relative to the outer surface of the downhole tool. As further described below, the use of tilted and non-tilted transducers provides measurements of sound paths that are two different lengths. The difference in arrival times of the two sound pulses can be used to determine an in-situ velocity of sound downhole. The velocity measurement may be used to calculate various downhole parameters (e.g., borehole diameters).

Figure 1:
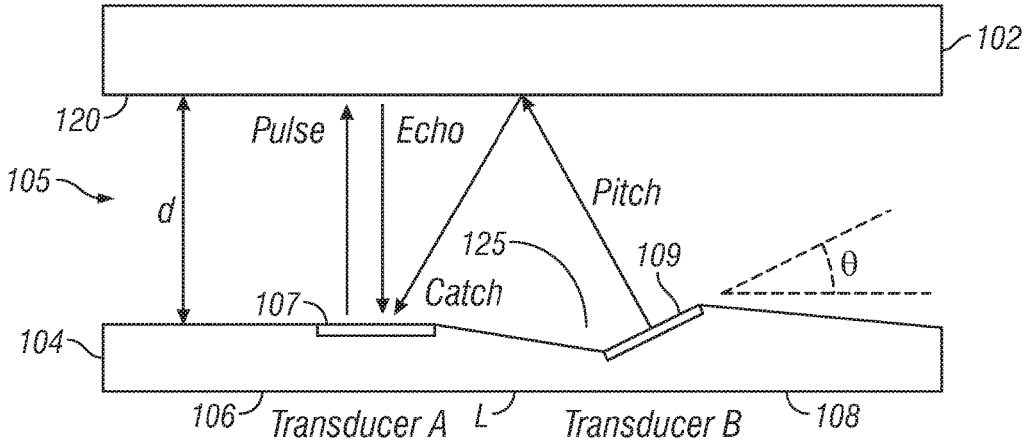
FIG. 1 illustrates a downhole tool having transducers, according to example embodiments.

FIG. 1 illustrates a downhole tool having transducers, according to example embodiments. FIG. 1 illustrates a downhole tool 104 that may be part of a drill string for drilling into a formation 102. As shown, the downhole tool 104 is within a borehole that is drilled into the formation 102. An example MWD operating environment wherein the downhole tool 104 may operate is described in more detail below. The formation 102 comprises a face 120. An annulus 105 is between the downhole tool 104 and the formation 102. From the Earth's surface to downhole, a drilling fluid may pass through a drill string (including the downhole tool 104) and out an end of a drill bit positioned at the end of the drill string. The drilling fluid may then return to the Earth's surface through the annulus 105. A standoff (from the downhole tool 104 to the formation 102) is a distance d. A number of downhole measurements are sensitive to the standoff. For example, a measurement of a resistivity of the formation may be corrected to account for the standoff. Moreover, determining the standoff along different points at different depths of the borehole also allows for a determination of a shape of the borehole. For well completion, a knowledge of the shape of the borehole is important in the calculation of the in hole-volume calculations for cementing.

The downhole tool 104 comprises a transducer 106 and a transducer 108. The transducer 106 and the transducer 108 may emit and detect acoustic waves. For example, the transducer 106 and the transducer 108 may emit and detect ultrasonic waves. Depending on the type of operation, in some embodiments, the transducer 106 and the transducer 108 may be only an emitter or a detector. In particular, if the transducer only provides for emission of acoustic waves, the transducer may be only an emitter. The transducer 106 and the transducer 108 include a face 107 and a face 109, respectively.

The face 107 of the transducer 106 is generally parallel to the face 120 of the formation 102. While the face 107 of the transducer 106 is at the outer diameter of the downhole tool 104, embodiments are not so limited. For example, in some embodiments, the transducer 106 may be embedded in the downhole tool 104 a given depth. The face of transducer may be covered by different material for protection of the face 107, while allowing for the emission of the acoustic waves without interference.

The face 109 of the transducer 108 is not parallel with the face 120 of the formation 102. The transducer 108 is tilted at some angle, θ, relative to the surface of the downhole tool 104 and the face 120 of the formation 102. In some embodiments, the angle may be in a range of 1 to 89 degrees. For examples, the angle may be approximately 5 degrees, 10 degrees, 15 degrees, 20 degrees, 25 degrees, 30 degrees, 35 degrees, 40 degrees, 45 degrees, 50 degrees, 55 degrees, 60 degrees, 65 degrees, 70 degrees, 75 degrees, 80 degrees, 85 degrees, etc. As shown, because of the angle of the transducer 108, an opening 125 is cut into the downhole tool 104. In some embodiments, the opening 125 is filled with different material to protect the face 109 while allowing for the emission of the acoustic waves without interference. The distance between the transducer 106 and the transducer 108 is L.

The transducer 106 and the transducer 108 may comprise a piezoelectric ceramic or a magnetostrictive material that converts electric energy into vibration and vice versa. The transducer 106 may operate both as a transmitter and a receiver. In operation, in some embodiments, the transducer 106 operates in a pulse-echo mode. The transducer 106 is configured to emit a pulse (e.g., in a collimated fashion) in a direction substantially toward the surface 120 of the formation 102. The transducer 106 then receives the reflection of the vibration off the surface 120 (the echo). The transducer 106 may determine the travel time ($t_A$) of the reflected pulse.

In operation, in some embodiments, the transducer 108 operates in a pitch-catch mode. The transducer 108 is configured to emit a pulse towards the face 120 of the formation 102 at an angle, θ (the pitch). The pulse is then reflected, according to Snell's law. The reflection is received by the transducer 106 (the catch). The travel time ($t_B$) of the reflected pulse may be determined. The difference in the two travel times, $t_A$ and $t_B$ is due to a difference in the path length in the drilling fluid for the two pulses. Therefore, these two measurements may be used to calculate an acoustic velocity (v) in the drilling fluid. In particular, $$t_{A_}=2d/v$$

and $$t_{B_}2((L/2)^2+d^2)^{1/2/}v$$

Therefore:

$$v=L(t_B^2-t_A^2)^{-1/2}$$

Electronics (such as a processor) may determine the velocity (v). Such electronics may be downhole, at the surface (local or remote to the drilling site) or a combination thereof.

In some embodiments, to remove the impact of a bad measurement, a "moving-average" speed of sound will be maintained, based on a fixed number of previous good measurements. The current speed of sound measurement will be compared to this average. If the current speed and the average differ by a given amount, the current speed is discarded. In some embodiments, if the current speed does not differ by the given amount, the current speed is considered a good measurement and is used to update the moving average. The current moving average speed of sound may be used to convert the travel time measured by the transducer 106 in the "pulse-echo" mode into a stand-off to the borehole wall. This measurement of the stand-off may be used by other instruments or tools in the drill string.

Figure 2:
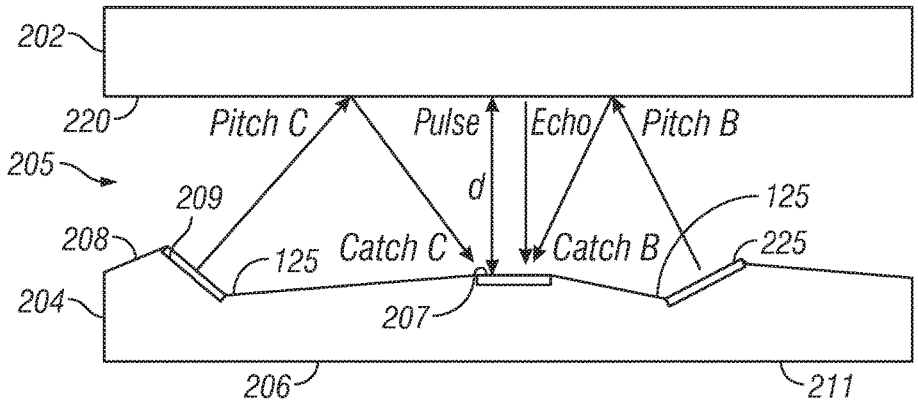
FIG. 2 illustrates a downhole tool having transducers, according to other example embodiments.

In some embodiments, three or more transducers may be used to determine the acoustic velocity. FIG. 2 illustrates a downhole tool having transducers, according to other example embodiments. In this configuration, the downhole tool comprises two transducers separated by different longitudinal distances from the main "pulse-echo" transducer.

FIG. 2 illustrates a downhole tool 204 that may be part of a drill string for drilling into a formation 202. As shown, the downhole tool 204 is within a borehole that is drilled into the formation 202. An example MWD operating environment wherein the downhole tool 204 may operate is described in more detail below. The formation 202 comprises a face 220. An annulus 205 is between the downhole tool 204 and the formation 202. From the Earth's surface to downhole, a drilling fluid may pass through a drill string (including the downhole tool 204) and out an end of a drill bit positioned at the end of the drill string. The drilling fluid may then return to the Earth's surface through the annulus 205. A standoff (from the downhole tool 204 to the formation 202) is a distance d.

The downhole tool 204 comprises a transducer 206, a transducer 208 and a transducer 211. The transducer 206, the transducer 208 and the transducer 211 may emit and detect acoustic waves. For example, the transducer 206, the transducer 208 and the transducer 211 may emit and detect ultrasonic waves. Depending on the type of operation, in some embodiments, the transducer 206, the transducer 208 and the transducer 211 may be only an emitter or a detector. In particular, if the transducer only provides for emission of acoustic waves, the transducer may be only an emitter. The transducer 206, the transducer 208 and the transducer 211 include a face 207, a face 209 and a face 225, respectively.

The face 207 of the transducer 206 is generally parallel to the face 220 of the formation 202. While the face 207 of the transducer 206 is at the outer diameter of the downhole tool 204, embodiments are not so limited. For example, in some embodiments, the transducer 206 may be embedded in the downhole tool 204 a given depth. The face of transducer may be covered by different material for protection of the face 207, while allowing for the emission of the acoustic waves without interference.

In an option, the face 209 and the face 225 are not parallel with the face 220 of the formation 202. The transducer 208 and the transducer 211 are tilted at some angle, θ, relative to the surface of the downhole tool 204 and the face 220 of the formation 202. In some embodiments, the distance from the transducer 211 to the transducer 206 and the distance from the transducer 225 to the transducer 206 are the same. In some embodiments, such distances are different. Moreover, the angle, θ, for the transducer 211 and the transducer 225 may be the same or different. In some embodiments, the angles may be in a range of 1 to 89 degrees. For examples, the angles may be approximately 5 degrees, 10 degrees, 15 degrees, 20 degrees, 25 degrees, 30 degrees, 35 degrees, 40 degrees, 45 degrees, 50 degrees, 55 degrees, 60 degrees, 65 degrees, 70 degrees, 75 degrees, 80 degrees, 85 degrees, etc. As shown, because of the angles of the transducer 108 and the transducer 211, an opening 125 is cut into the downhole tool 104. In some embodiments, the opening 125 is filled with different material to protect the faces 209 and 225 while allowing for the emission of the acoustic waves without interference.

The transducer 206, the transducer 208 and the transducer 211 may comprise a piezoelectric ceramic or a magnetostrictive material that converts electric energy into vibration and vice versa. The transducer 206 may operate both as a transmitter and a receiver. In operation, in some embodiments, the transducer 206 operates in a pulse-echo mode. The transducer 206 is configured to emit a pulse (e.g., in a collimated fashion) in a direction substantially toward the surface 220 of the formation 202. The transducer 206 then receives the reflection of the vibration off the surface 220 (the echo). The transducer 206 may determine the travel time ($t_A$) of the reflected pulse.

In operation, in some embodiments, the transducer 208 and the transducer 211 operate in a pitch-catch mode. The transducer 208 and the transducer 211 are configured to emit a pulse towards the face 220 of the formation 202 at an angle, θ (the pitch). The pulse is then reflected, according to Snell's law. The reflections are received by the transducer 206 (the catch). The travel time ($t_B$) and the travel time ($t_C$) for the pulse from the transducer 208 and the transducer 211, respectively, of the reflected pulses may be determined. The pairs of measurements ($t_A$, $t_B$) and ($t_A$, $t_C$) may be used to calculate two values for the acoustic velocity. Each of the two values for the acoustic velocity may be compared to the moving-average speed of sound (as described above). While described with two and three transducers, some embodiments may incorporate any number of transducers therein.

Figure 3:
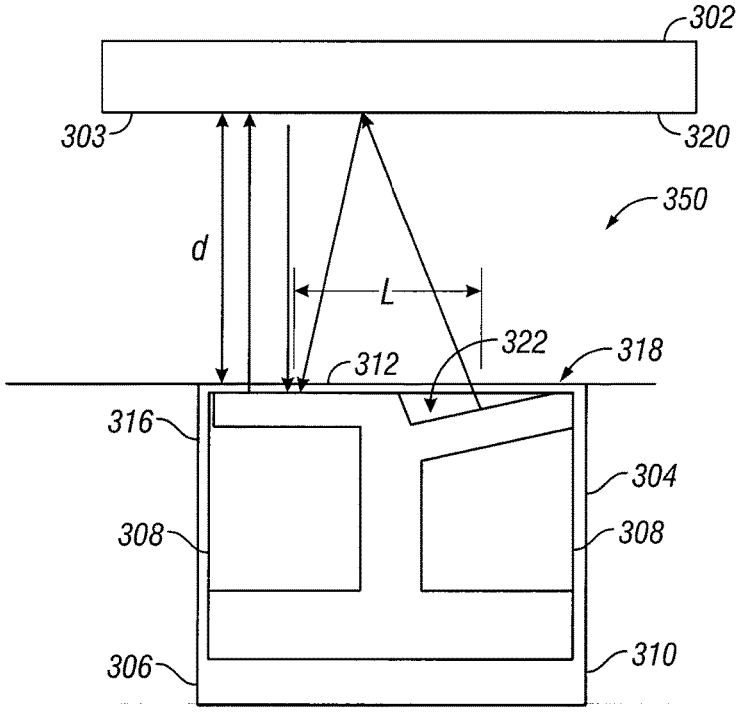
FIG. 3 illustrates a downhole tool having transducers, according to other example embodiments.

FIG. 3 illustrates a downhole tool having transducers, according to other example embodiments. FIG. 3 illustrates a downhole tool 304 that may be part of a drill string for drilling into a formation 302. As shown, the downhole tool 304 is within a borehole that is drilled into the formation 302. An example MWD operating environment wherein the downhole tool 304 may operate is described in more detail below. The formation 302 comprises a face 303. An annulus 350 is between the downhole tool 304 and the formation 302. From the Earth's surface to downhole, a drilling fluid may pass through a drill string (including the downhole tool 304) and out an end of a drill bit positioned at the end of the drill string. The drilling fluid may then return to the Earth's surface through the annulus 350. A standoff (from the downhole tool 304 to the formation 302) is a distance d. In comparison to the configurations of FIGS. 1 and 2, FIG. 3 comprises a dual-element acoustic transducer. Accordingly, two acoustic transducers are in a same casing, thereby reducing its footprint. The operations are similar to those described for the configuration of FIG. 1. While described such that two transducer elements are in a same casing, in some embodiments, any number of such elements may be in a same casing. For example, a configuration similar to FIG. 3 may be in a same casing.

The downhole tool 304 comprises a dual-element transducer 306. The dual-element transducer 306 includes a casing 310. The casing 310 encloses a first acoustic element 316 and a second acoustic element 318. The dual-element transducer 306 also includes a backing material 314 for both element 316 and 318. An acoustic matching material 322 is positioned in front of the second acoustic element 318 (relative to the face of the dual-element transducer 306). A wear plate 312 is positioned in front of both first acoustic transducer element 316 and the second acoustic transducer element 318.

The first acoustic transducer element 316 and the second acoustic transducer element 318 may emit and detect acoustic waves. For example, the transducer element 316 and the transducer element 318 may emit and detect ultrasonic waves. Depending on the type of operation, in some embodiments, the transducer element 316 and the transducer element 318 may be only an emitter or a detector. In particular, if the transducer only provides for emission of acoustic waves, the transducer may be only an emitter. The transducer element 316 and the transducer element 318 include a face 370 and a face 372, respectively.

The face 370 of the transducer element 316 is essentially parallel to the face 303 of the formation 302. While the face 370 of the transducer element 316 is at the outer diameter of the downhole tool 304, embodiments are not so limited. For example, in some embodiments, the transducer element 316 may be embedded in the downhole tool 304 a given depth.

The face 372 of the transducer element 318 is not parallel with the face 303 of the formation 302. The transducer element 318 is tilted at some angle, θ, relative to the surface of the downhole tool 304 and the face 303 of the formation 302. In some embodiments, the angle may be in a range of 1 to 89 degrees. For examples, the angle may be approximately 5 degrees, 10 degrees, 15 degrees, 20 degrees, 25 degrees, 30 degrees, 35 degrees, 40 degrees, 45 degrees, 50 degrees, 55 degrees, 60 degrees, 65 degrees, 70 degrees, 75 degrees, 80 degrees, 85 degrees, etc. The distance between the transducer element 316 and the transducer element 318 is L.

The transducer element 316 and the transducer element 318 may comprise a piezoelectric ceramic or a magnetostrictive material that converts electric energy into vibration and vice versa. The transducer element 316 may operate both as a transmitter and a receiver. In operation, in some embodiments, the transducer element 316 operates in a pulse-echo mode. The transducer element 316 is configured to emit a pulse (e.g., in a collimated fashion) in a direction substantially toward the surface 303 of the formation 302. The transducer element 316 then receives the reflection of the vibration off the surface 302 (the echo). The transducer element 316 may determine the travel time ($t_A$) of the reflected pulse.

In operation, in some embodiments, the transducer element 318 operates in a pitch-catch mode. The transducer element 318 is configured to emit a pulse towards the face 303 of the formation 302 at an angle, θ (the pitch). The pulse is then reflected, according to Snell's law. The reflection is received by the transducer element 316 (the catch). The travel time ($t_B$) of the reflected pulse may be determined. The difference in the two travel times, $t_A$ and $t_B$ is due to a difference in the path length in the drilling fluid for the two pulses. Therefore, these two measurements may be used to calculate an acoustic velocity (v) in the drilling fluid. In particular, $$t_A = 2d/v$$

and $$t_B = 2((L/2)^2 + d^2)^{1/2}/v$$

Therefore:

$$v = L(t_B - t_A^2)^{-1/2}$$

Electronics (such as a processor) may determine the velocity (v). Such electronics may be downhole, at the surface (local or remote to the drilling site) or a combination thereof.

In some embodiments, to remove the impact of a bad measurement, a "moving-average" speed of sound will be maintained, based on a fixed number of previous good measurements. The current speed of sound measurement will be compared to this average. If the current speed and the average differ by a given amount, the current speed is discarded. In some embodiments, if the current speed does not differ by the given amount, the current speed is considered a good measurement and is used to update the moving average. The current moving average speed of sound may be used to convert the travel time measured by the transducer 106 in the "pulse-echo" mode into a stand-off to the borehole wall. This measurement of the stand-off may be used by other instruments or tools in the drill string.

FIGS. 5-12 illustrate an example of devices that can be used in a method of measurement, which can be used alone or in combination with other embodiments herein. In measuring the acoustic velocity of the drilling fluid, the measurement can be more accurately made by cleaning formation cuttings from the location where the measurement is taken. For instance a measurement can be taken in a cavity 510 using one or more transducers 512, where the cavity 510 is recessed within a portion of the downhole tool or wire. The cavity 510 includes an opening 516 to the drilling fluid, and the cavity 510 is recessed from an outer surface 514 of the tool or wireline. In an option, a cavity cleaning piston 520 is movably disposed within the cavity 510, and moves along a piston axis. The piston 520 has multiple positions within the cavity 510 The piston 520 optionally has a similar cross-section as the cross-section of the cavity. The formation cuttings are cleaned from the cavity in several different manners.

Figure 5:
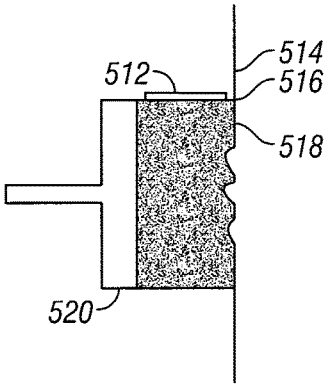
FIG. 5 illustrates a portion of a downhole tool having at least one transducer, according to example embodiments.
Figure 6:
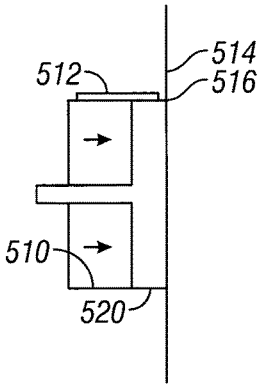
FIG. 6 illustrates a portion of a downhole tool having at least one transducer, according to example embodiments.
Figure 7:
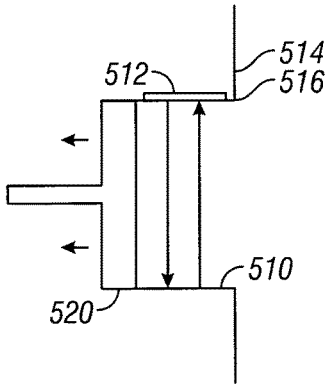
FIG. 7 illustrates a portion of a downhole tool having at least one transducer, according to example embodiments.

In an example, for instance shown in FIGS. 5-7, the piston 520 remains in a default position recessed away from the opening 516 (FIG. 5), which allows for cuttings 518 to be packed within the cavity 510 during the downhole processing, such as drilling. When it is desired to make a fluid acoustic velocity measurement, the cavity 510 can be cleaned by moving the piston 520 toward the outer surface 514 of the tool such that the cuttings packed within the cavity 510 are displaced out of the cavity 510, as shown in FIG. 6. The piston 520 retracts away from the outer surface 514 and back within the cavity 510, as shown in FIG. 7. Since the piston 520 is retracted, drilling fluid fills the cavity 510. The transducer 512 sends a signal and measures time of flight across the cavity 510. The information from the transducer 512 can be used to determine the drilling fluid velocity, for instance with a processor, as discussed above. In an option, the transducer 512 may operate both as a transmitter and a receiver. The transducer 512 is configured to emit a pulse, in an example, in a direction substantially toward an opposite surface of the cavity 510. The transducer 512 then receives the reflection of the vibration off the surface (the echo), which is used to determine the travel time of the reflected pulse.

Figure 8:
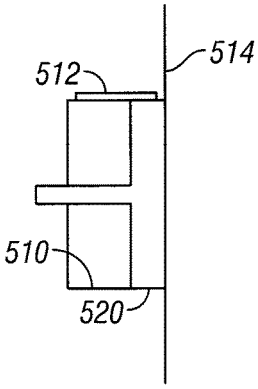
FIG. 8 illustrates a portion of a downhole tool having at least one transducer, according to example embodiments.
Figure 9:
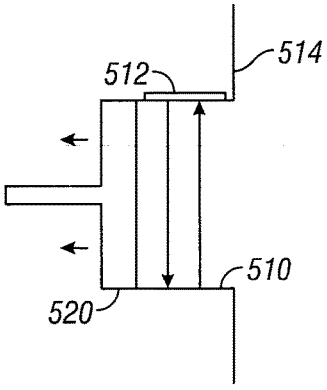
FIG. 9 illustrates a portion of a downhole tool having at least one transducer, according to example embodiments.

In another example, as shown in FIGS. 8 and 9, the piston 520 has a default position that is substantially flush with the outer surface 514 of the tool, preventing any cuttings from filling the cavity 510. The piston 520 is retracted within the cavity, and drilling fluid fills the cavity 510. A measurement of the fluid is then taken. For example, the transducer 512 emits a pulse as described above, in an example, in a direction substantially toward an opposite surface of the cavity 510. A portion of the cavity acts as a reflector and reflects the pulse. The transducer 512 then receives the reflection of the vibration off the surface (the echo), and the information is used to determine the travel time of the reflected pulse.

Figure 11:
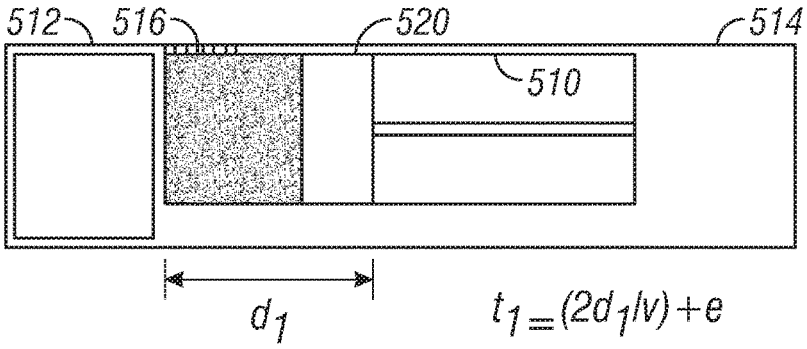
FIG. 11 illustrates a portion of a downhole tool having at least one transducer, according to example embodiments.
Figure 12:
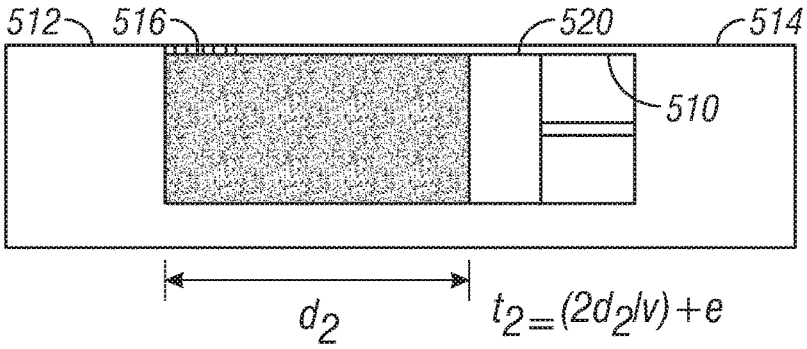
FIG. 12 illustrates a portion of a downhole tool having at least one transducer, according to example embodiments.
Figure 10:
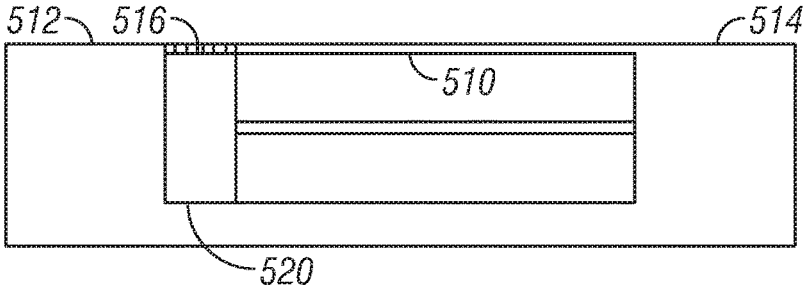
FIG. 10 illustrates a portion of a downhole tool having at least one transducer, according to example embodiments.

FIGS. 10-12 illustrate another example of the method of measurement. The downhole tool includes a cavity 510 therein, and the cavity 510 has an opening 516 allowing access to the cavity 510. Disposed on or in the opening 516 is a grate 530, which operates as a filter. The piston 520 can have multiple positions and in an option is disposed over the opening 516, or otherwise closes the opening 516 in a closed position. The piston 520 is retracted within the cavity and away from the opening 516, as shown in FIG. 11, and draws drilling fluid within the cavity 510. In an option, the piston 520 moves along a piston axis which is substantially parallel with the outer surface 514 of the tool. The drilling fluid is then measured, for example, the acoustic velocity is measured. For example, the transducer 512 emits a pulse as described above, and receives the reflection of the vibration off a surface (the echo), which is used to determine the travel time of the reflected pulse.

In a further option, the surface of the piston acts as the reflector for the acoustic energy from the transducer 512. In yet another option, a transducer is also on the piston 520, resulting in a transmitter and receiver arrangement. The piston 520 can have multiple positions and in an option is disposed in two or more positions, such as at least a first position and a second position. In an example, the piston 520 is disposed in positions $d_1$ and $d_2$, as shown in FIGS. 11 and 12, where the distance d is measured from a face of the piston to the transducer 512. The travel time of the acoustic energy can be measured as follows:

$$t_1=(2d_1/v)+e$$

and $$t_2=(2d_2/v)+e$$

The difference in the two travel times, $t_1$ and $t_2$ is due to a difference in the path length in the drilling fluid for the two pulses. Therefore, by subtracting the measured values of these two measurements $t_1$ and $t_2$, the offset error e can be eliminated.

In a further option, the embodiments can be used to detect downhole gas. For instance, when gas bubbles are entering the mud downhole, the acoustic velocity of the mud will decrease. In detecting a decrease in the acoustic velocity of the mud, this can be used as an early warning that gas may be in the system. In measuring the velocity of the mud downhole, the information regarding the decrease in velocity, or potential presence of gas, can be obtained earlier than when the measurements are taken from the surface.

Figure 4A:
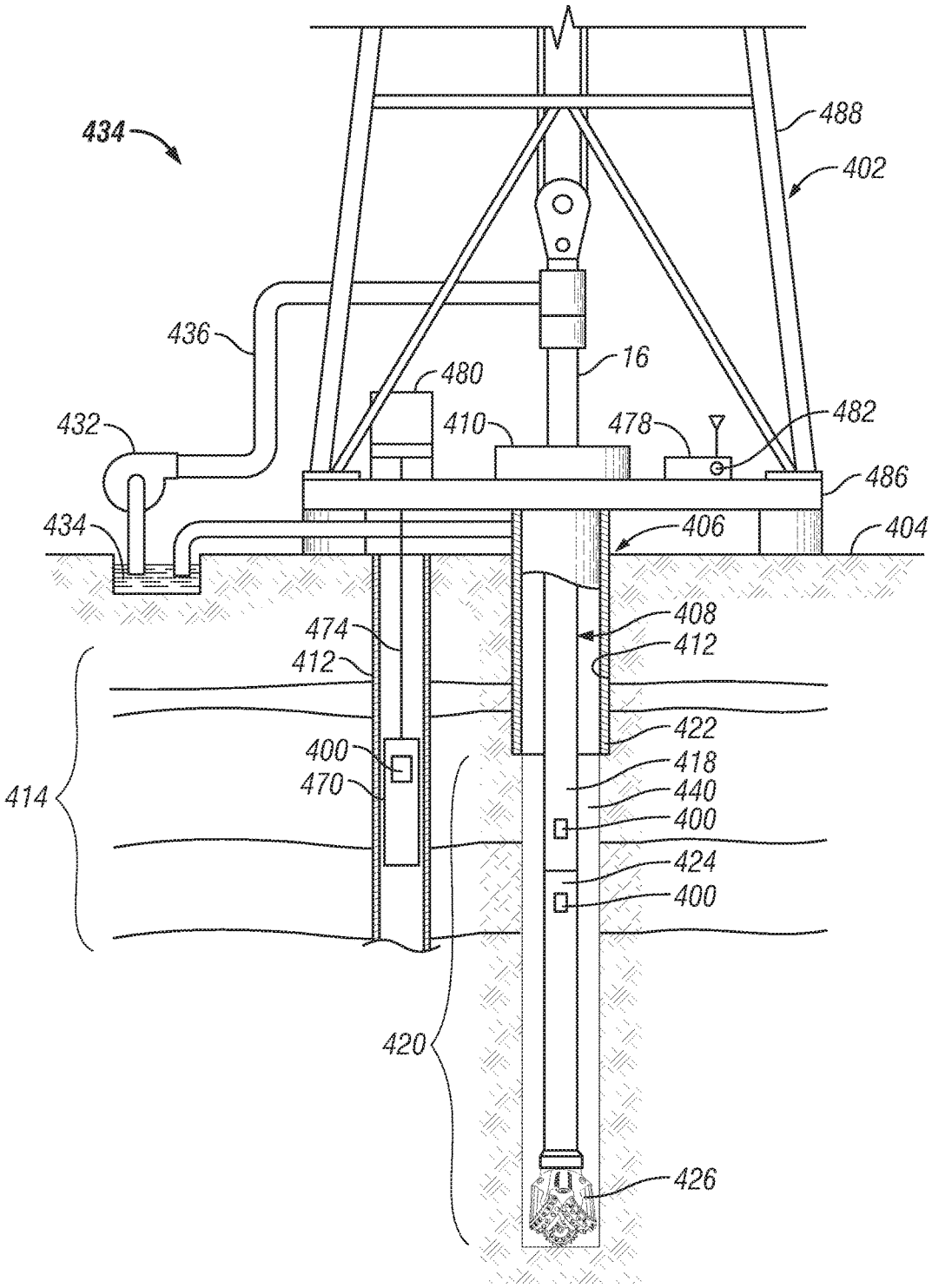
FIG. 4A illustrates a drilling well during Measurement While Drilling (MWD) operations, Logging While Drilling (LWD) operations or Surface Data Logging (SDL) operations, according to some embodiments.

Wellsite operating environments, according to some embodiments in which the above-described measurement techniques and systems can be used, are now described. FIG. 4A illustrates a drilling well during Measurement While Drilling (MWD) operations, Logging While Drilling (LWD) operations or Surface Data Logging (SDL) operations, according to some embodiments. It can be seen how a system 464 may also form a portion of a drilling rig 402 located at a surface 404 of a well 406. The drilling rig 402 may provide support for a drill string 408. The drill string 408 may operate to penetrate a rotary table 410 for drilling a borehole 412 through subsurface formations 414. The drill string 408 may include a Kelly 416, drill pipe 418, and a bottom hole assembly 420, perhaps located at the lower portion of the drill pipe 418.

The bottom hole assembly 420 may include drill collars 422, a downhole tool 424, and a drill bit 426. The drill bit 426 may operate to create a borehole 412 by penetrating the surface 404 and subsurface formations 414. The downhole tool 424 may comprise any of a number of different types of tools including MWD (measurement while drilling) tools, LWD (logging while drilling) tools, and others.

During drilling operations, the drill string 408 (perhaps including the Kelly 416, the drill pipe 418, and the bottom hole assembly 420) may be rotated by the rotary table 410. In addition to, or alternatively, the bottom hole assembly 420 may also be rotated by a motor (e.g., a mud motor) that is located downhole. The drill collars 422 may be used to add weight to the drill bit 426. The drill collars 422 also may stiffen the bottom hole assembly 420 to allow the bottom hole assembly 420 to transfer the added weight to the drill bit 426, and in turn, assist the drill bit 426 in penetrating the surface 404 and subsurface formations 414.

During drilling operations, a mud pump 432 may pump drilling fluid (sometimes known by those of skill in the art as "drilling mud") from a mud pit 434 through a hose 436 into the drill pipe 418 and down to the drill bit 426. The drilling fluid can flow out from the drill bit 426 and be returned to the surface 404 through an annular area 440 between the drill pipe 418 and the sides of the borehole 412. The drilling fluid may then be returned to the mud pit 434, where such fluid is filtered. In some embodiments, the drilling fluid can be used to cool the drill bit 426, as well as to provide lubrication for the drill bit 426 during drilling operations. Additionally, the drilling fluid may be used to remove subsurface formation 414 cuttings created by operating the drill bit 426.

Figure 4B:
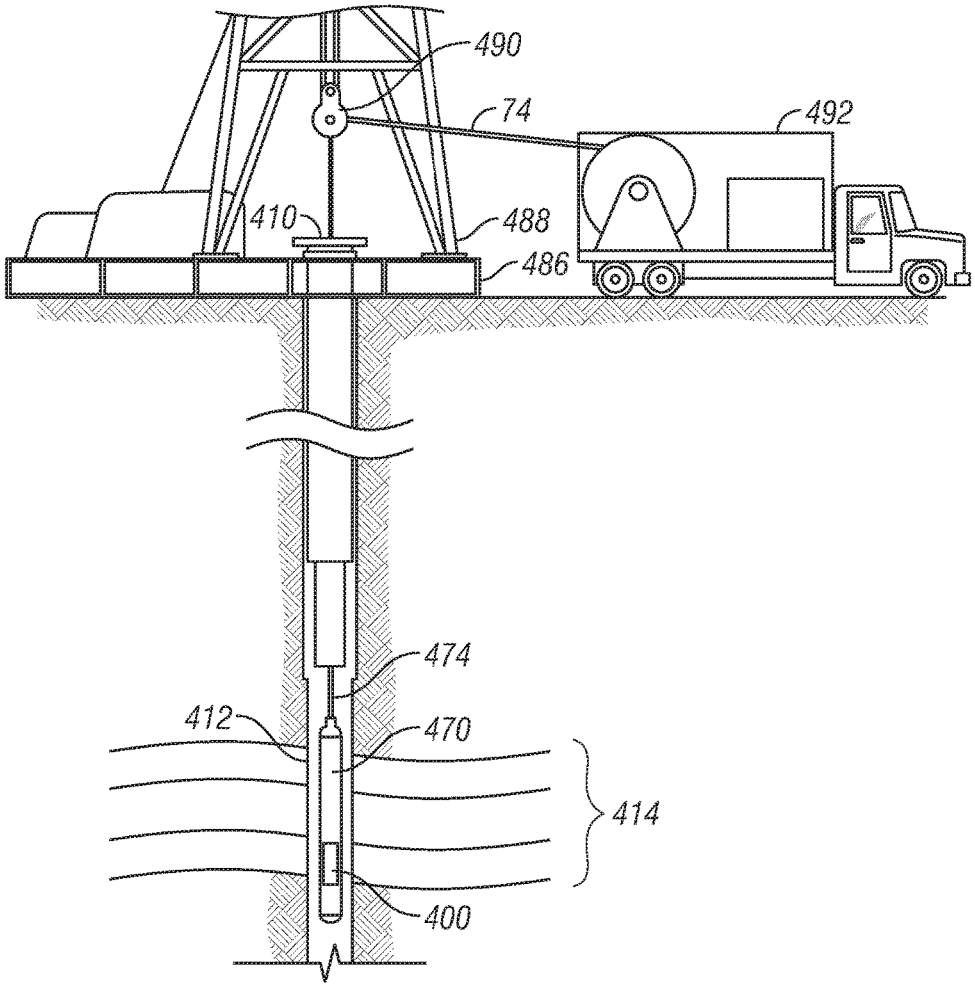
FIG. 4B illustrates a drilling well during wireline logging operations, according to some embodiments.

FIG. 4B illustrates a drilling well during wireline logging operations, according to some embodiments. A drilling platform 486 is equipped with a derrick 488 that supports a hoist 490. Drilling of oil and gas wells is commonly carried out by a string of drill pipes connected together so as to form a drilling string that is lowered through a rotary table 410 into a wellbore or borehole 412. Here it is assumed that the drilling string has been temporarily removed from the borehole 412 to allow a wireline logging tool body 470, such as a probe or sonde, to be lowered by wireline or logging cable 474 into the borehole 412. Typically, the tool body 470 is lowered to the bottom of the region of interest and subsequently pulled upward at a substantially constant speed. During the upward trip, instruments included in the tool body 470 may be used to perform measurements on the subsurface formations 414 adjacent the borehole 412 as they pass by. The measurement data can be communicated to a logging facility 492 for storage, processing, and analysis. The logging facility 492 may be provided with electronic equipment for various types of signal processing. Similar log data may be gathered and analyzed during drilling operations (e.g., during Logging While Drilling, or LWD operations).

In the description, numerous specific details such as logic implementations, opcodes, means to specify operands, resource partitioning/sharing/duplication implementations, types and interrelationships of system components, and logic partitioning/integration choices are set forth in order to provide a more thorough understanding of the present invention. It will be appreciated, however, by one skilled in the art that embodiments of the invention may be practiced without such specific details. In other instances, control structures, gate level circuits and full software instruction sequences have not been shown in detail in order not to obscure the embodiments of the invention. Those of ordinary skill in the art, with the included descriptions will be able to implement appropriate functionality without undue experimentation.

References in the specification to "one embodiment", "an embodiment", "an example embodiment", etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described.

In view of the wide variety of permutations to the embodiments described herein, this detailed description is intended to be illustrative only, and should not be taken as limiting the scope of the invention. What is claimed as the invention, therefore, is all such modifications as may come within the scope of the following claims and equivalents thereto. Therefore, the specification and drawings are to be regarded in an illustrative rather than a restrictive sense.

What is claimed is:

1. A method comprising:

emitting a first acoustic pulse into a drilling fluid in a well bore, using a first acoustic transducer in a downhole tool, wherein a face of the first acoustic transducer is at an angle that is not parallel to an outer surface of the downhole tool;

detecting the first acoustic pulse after the first acoustic pulse has traveled through the drilling fluid and reflected off a wall of the well bore, using a second acoustic transducer in the downhole tool, wherein a face of the second acoustic transducer is approximately parallel with the outer surface of the downhole tool;

emitting a second acoustic pulse into the drilling fluid in the well bore, using the second acoustic transducer;

detecting the second acoustic pulse after the second acoustic pulse has traveled through the drilling fluid and reflected off the wall of the well bore, using the second acoustic transducer; and determining an acoustic velocity of the drilling fluid based on a travel time of the first acoustic pulse and a travel time of the second acoustic pulse.

2. The method of claim 1, further comprising:

emitting a third acoustic pulse into the drilling fluid in the well bore, using a third acoustic transducer in the downhole tool, wherein a face of the third acoustic transducer is at an angle that is not parallel to the outer surface of the downhole tool;

detecting the third acoustic pulse after the third acoustic pulse has traveled through the drilling fluid and reflected off the wall of the well bore, using the second acoustic transducer; and determining the acoustic velocity of the drilling fluid based on a travel time of the third acoustic pulse.

3. The method of claim 1, wherein the first acoustic transducer and the second acoustic transducer are part of a same dual-element transducer.

4. The method of claim 3, wherein the first acoustic transducer and the second acoustic transducer are separated a distance L, wherein an acoustic insulation is between the first acoustic transducer and the second acoustic transducer.

5. The method of claim 4, wherein a material is between the second acoustic transducer and a face of the outer surface of the downhole tool.

6. The method of claim 5, wherein the material has an acoustic impedance that is approximately equal to an acoustic impedance of the drilling fluid.

7. An apparatus comprising:

a first acoustic transducer disposed on a downhole tool, wherein a face of the first acoustic transducer is at an angle that is not parallel to an outer surface of the downhole tool, wherein the first acoustic transducer is to emit a first acoustic pulse into a drilling fluid in a well bore; and a second acoustic transducer disposed on the downhole tool, wherein a face of the second acoustic transducer is approximately parallel with the outer surface of the downhole tool, wherein the second acoustic transducer is to detect the first acoustic pulse after the first acoustic pulse has traveled through the drilling fluid and reflected off a wall of the well bore, wherein the second acoustic transducer is to emit a second acoustic pulse into the drilling fluid in the well bore, and wherein the second acoustic transducer is to detect the second acoustic pulse after the second acoustic pulse has traveled through the drilling fluid and reflected off the wall of the well bore.

8. The apparatus of claim 7, further comprising a processor element to measure an acoustic velocity of the drilling fluid based on a travel time of the first acoustic pulse and a travel time of the second acoustic pulse.

9. The apparatus of claim 7, further comprising a processor element to measure an acoustic velocity of the drilling fluid based on a travel time of the first acoustic pulse and a travel time of the second acoustic pulse if the acoustic velocity is within a predetermined range of a moving-average speed for measured acoustic velocities.

10. The apparatus of claim 7, further comprising a third acoustic transducer to emit a third acoustic pulse into the drilling fluid in the well bore, wherein a face of the third acoustic transducer is at an angle that is not parallel to the outer surface of the downhole tool.

11. The apparatus of claim 10, wherein the second acoustic transducer is to detect the third acoustic pulse after the third acoustic pulse has traveled through the drilling fluid and reflected off the wall of the well bore.

12. The apparatus of claim 11, further comprising a processor element to measure an acoustic velocity of the drilling fluid based on a travel time of the first acoustic pulse, a travel time of the second acoustic pulse and a travel time of the third acoustic pulse.

13. A system comprising:

a drill string having a downhole tool, wherein the downhole tool comprises, a first acoustic transducer, wherein a face of the first acoustic transducer is at an angle that is not parallel to an outer surface of the downhole tool, wherein the first acoustic transducer is to emit a first acoustic pulse into a drilling fluid in a well bore; and a second acoustic transducer, wherein a face of the second acoustic transducer is approximately parallel with the outer surface of the downhole tool, wherein the second acoustic transducer is to detect the first acoustic pulse after the first acoustic pulse has traveled through the drilling fluid and reflected off a wall of the well bore, wherein the second acoustic transducer is to emit a second acoustic pulse into the drilling fluid in the well bore, and wherein the second acoustic transducer is to detect the second acoustic pulse after the second acoustic pulse has traveled through the drilling fluid and reflected off the wall of the well bore.

14. The system of claim 13, wherein the first acoustic transducer and the second acoustic transducer are part of a same dual-element transducer.

15. The system of claim 14, wherein the first acoustic transducer and the second acoustic transducer are separated by a distance L, wherein an acoustic insulation is between the first acoustic transducer and the second acoustic transducer.

16. The system of claim 15, wherein a material is between the second acoustic transducer and a face of the outer surface of the downhole tool.

17. The system of claim 16, wherein the material has an acoustic impedance that is approximately equal to an acoustic impedance of the drilling fluid.

18. The system of claim 13, wherein the downhole tool further comprises a processor element to measure an acoustic velocity of the drilling fluid based on a travel time of the first acoustic pulse and a travel time of the second acoustic pulse.

19. The system of claim 13, wherein the downhole tool further comprises a processor element to measure an acoustic velocity of the drilling fluid based on a travel time of the first acoustic pulse and a travel time of the second acoustic pulse if the acoustic velocity is within a predetermined range of a moving-average speed for measured acoustic velocities.

20. The system of claim 13, wherein the downhole tool further comprises a third acoustic transducer to emit a third acoustic pulse into the drilling fluid in the well bore, wherein a face of the third acoustic transducer is at an angle that is not parallel to the outer surface of the downhole tool.

21. The system of claim 13, wherein the second acoustic transducer is to detect the third acoustic pulse after the third acoustic pulse has traveled through the drilling fluid and reflected off the wall of the well bore.

22. The system of claim 18, wherein the downhole tool further comprises a processor element to measure an acoustic velocity of the drilling fluid based on a travel time of the first acoustic pulse, a travel time of the second acoustic pulse and a travel time of the third acoustic pulse.

23. A method comprising:

disposing a tool downhole within a borehole, the tool having a cavity therein and a movable piston disposed within the cavity;

cleaning the cavity of formation cuttings, wherein the cleaning includes moving the retractable piston within the cavity;

measuring acoustic velocity of fluid within the cavity after the cavity is cleaned of formation cuttings; and determining an acoustic velocity of the fluid within the cavity as drilling fluid by: emitting a first acoustic pulse into a drilling fluid in the borehole, using a first acoustic transducer in the downhole tool, wherein a face of the first acoustic transducer is at an angle that is not parallel to an outer surface of the downhole tool; detecting the first acoustic pulse after the first acoustic pulse has traveled through the drilling fluid and reflected off a wall of the well bore, using a second acoustic transducer in the downhole tool, wherein a face of the second acoustic transducer is approximately parallel with the outer surface of the downhole tool; emitting a second acoustic pulse into the drilling fluid in the well bore, using the second acoustic transducer; detecting the second acoustic pulse after the second acoustic pulse has traveled through the drilling fluid and reflected off the wall of the well bore, using the second acoustic transducer; and determining the acoustic velocity of the drilling fluid based on a travel time of the first acoustic pulse and a travel time of the second acoustic pulse.

24. The method as recited in claim 23, wherein cleaning the cavity includes extending the piston and displacing formation cuttings from the cavity, and retracting the piston.

25. The method as recited in claim 23, further comprising flowing fluid through a cavity grate, where the cavity grate covers an opening to the cavity.

26. The method as recited in claim 25, further comprising disposing the piston over at least a portion of the cavity grate and preventing fluid from entering the cavity.

27. The method as recited in claim 26, wherein disposing the piston over the cavity grate includes placing the piston in a piston default position, and cleaning the cavity includes retracting the piston from the default position and allowing drilling fluid to enter the cavity.

28. The method as recited in claim 27, further comprising returning the piston to the piston default position.

29. The method as recited in claim 23, wherein cleaning the cavity includes retracting the piston from a position near an outer tool surface, allowing drilling fluid to enter the cavity.

30. The method as recited in claim 23, wherein measuring acoustic velocity of fluid within the cavity includes emitting an acoustic pulse from a transducer within the cavity.

31. The method as recited in claim 30, further comprising reflecting the acoustic pulse with the piston toward the transducer.

32. The method as recited in claim 31, further comprising measuring the acoustic velocity of the fluid when the piston in a first piston position, and measuring the acoustic velocity of the fluid when the piston is in a second piston position.

33. The method as recited in claim 32, further comprising comparing measurements in the first piston position and the second piston position and correcting measurements for offset errors.

34. An apparatus comprising:

a downhole tool having a cavity therein;

at least one acoustic transducer disposed within the cavity of the downhole tool;

a cavity cleaning piston disposed within the cavity, the piston movable relative to the acoustic transducer, the piston having and movable to at least a first position and a second position, and acoustic velocity is measured within the cavity with information from the at least one acoustic transducer in the cavity; and a first acoustic transducer and a second acoustic transducer disposed on a downhole tool, wherein a face of the first acoustic transducer is at an angle that is not parallel to an outer surface of the downhole tool and a face of the second acoustic transducer is approximately parallel to the outer surface of the downhole tool, wherein the first acoustic transducer is to emit a first acoustic pulse into a drilling fluid in a well bore, and wherein the second acoustic transducer is to detect the first acoustic pulse after the first acoustic pulse has traveled through the drilling fluid and reflected off a wall of the well bore, wherein the second acoustic transducer is to emit a second acoustic pulse into the drilling fluid in the well bore, and wherein the second acoustic transducer is to detect the second acoustic pulse after the second acoustic pulse has traveled through the drilling fluid and reflected off the wall of the well bore.

35. The apparatus as recited in claim 34, further comprising a grate disposed over an opening to the cavity.

36. The apparatus as recited in claim 35, wherein the piston covers the grate in a default position.

37. The apparatus as recited in claim 34, wherein the piston has a default position where an outer surface of the piston is substantially flush with an outer surface of the downhole tool.

* * * * *